United States Patent [19]

Wood

[11] 4,348,158

[45] Sep. 7, 1982

[54] SEWAGE PUMPING STATION

[75] Inventor: Marvin E. Wood, Lenexa, Kans.

[73] Assignee: Smith & Loveless, Inc., Lenexa, Kans.

[21] Appl. No.: 166,624

[22] Filed: Jul. 7, 1980

[51] Int. Cl.[3] ..... F04B 49/04

[52] U.S. Cl. ..... 417/40; 137/363; 406/99

[58] Field of Search ..... 417/36, 40, 360; 406/24, 99; 137/363, 372

[56] References Cited

U.S. PATENT DOCUMENTS

| | | | |
|---|---|---|---|
| 1,774,234 | 8/1930 | La Bour | 417/40 X |
| 1,955,787 | 4/1934 | Behringer | 137/21 |
| 1,964,033 | 6/1934 | Cook | 417/40 |
| 1,964,034 | 6/1934 | Cook | 137/363 X |
| 2,222,595 | 11/1940 | Regester | 417/40 X |
| 3,461,803 | 8/1969 | Stothoff et al. | 137/363 X |
| 3,558,012 | 1/1971 | Weis | 417/360 |
| 3,655,053 | 4/1972 | Hugin | 210/152 |
| 3,758,236 | 9/1973 | Zimmerman | 417/360 |
| 3,938,545 | 2/1976 | Nagy et al. | 417/360 X |
| 3,959,142 | 5/1976 | Dupre | 210/170 |

*Primary Examiner*—Carlton R. Croyle
*Assistant Examiner*—Edward Look
*Attorney, Agent, or Firm*—Dressler, Goldsmith, Shore, Sutker & Milnamow, Ltd.

[57] ABSTRACT

A sewage pumping or lift station is mounted on the upper edge of a standard concrete wet well. A vertical partition divides the station into a machinery chamber and an access chamber that are hermetically isolated from each other. The floor of the machinery chamber is imperforate except for a hole through which a sewage inlet pipe passes and that hole is sealed by weldments attaching the inlet pipe to the floor; this hermetically isolates the machinery chamber from the sewer gases in the wet well. Any other components which must communicate with the wet well pass through sealed holes in the vertical partition.

9 Claims, 3 Drawing Figures

Fig. 2.
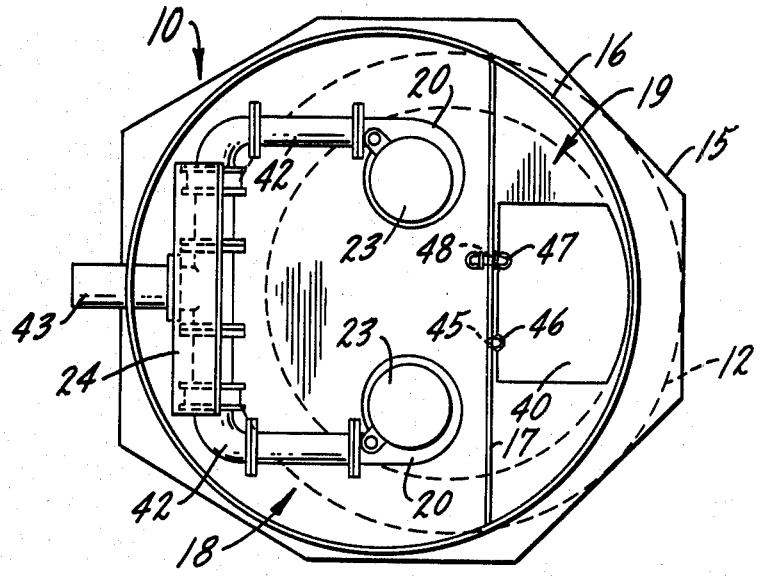
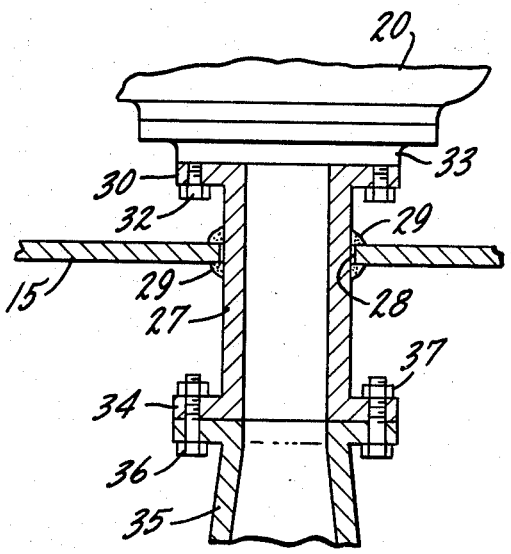
Fig. 3.

SEWAGE PUMPING STATION

BACKGROUND OF THE INVENTION

This invention relates to sewage pump station construction and more particularly to improvements which prevent noxious sewer gases such as methane and hydrogen sulfide from entering the enclosure in which machinery is housed.

Sewage pumping stations of the type that are mounted on top of a concrete sewage wet wall ordinarily have numerous holes and openings in the bottom deck plate or floor of the machinery enclosure. Bolts and other fasteners, connecting rods, rotating shafts, and electrical components and wires commonly extend through such holes, and access to the underside of the station for repair or maintenance has been provided by a removable lid covering a manway opening in such a bottom deck plate. Attempts to hermetically seal such holes and openings with conventional means such as gaskets have failed because bolts loosen from vibration and flexure of the deck plate, shafts and bushings wear loose, and all such components are subject to deterioration from the moisture and corrosive gasses that are almost always present at the underside of the deck plate. Breaking of the hermetic seal in any of these ways results in sewer gases entering the machinery enclosure where they present health hazards to workers and an explosion risk because the pumps are electrically powered. Also, any omission of a part or any error in the way such components are installed or sealed usually permit entry of these gases.

OBJECTIVES OF THE INVENTION

Accordingly, it is an object of this invention to provide an improved wet well mounted sewage pumping station.

Another object is to prevent sewer gases from entering the machinery compartment of a pump station.

Another object is to provide continuous access to the underside of a sewage pump station without causing an explosion hazard.

Another object is to protect workers from sewer gases.

Another object is to provide a rugged, relatively low cost, hazard free wet well mounted sewage pumping station that can be easily repaired and maintained, and which does not possess defects found in similar prior art devices.

Other objects and advantages will be apparent from the specification and claims and the scope of the invention will be set forth in the claims.

BRIEF DESCRIPTION OF THE DRAWING

FIG. 2 is a plan view taken along the line 2—2 in FIG. 1.

FIG. 3 is an enlarged, partially broken away cross-sectional view of the inlet pipe entering the pumping station.

DESCRIPTION OF THE INVENTION

Figure 1:
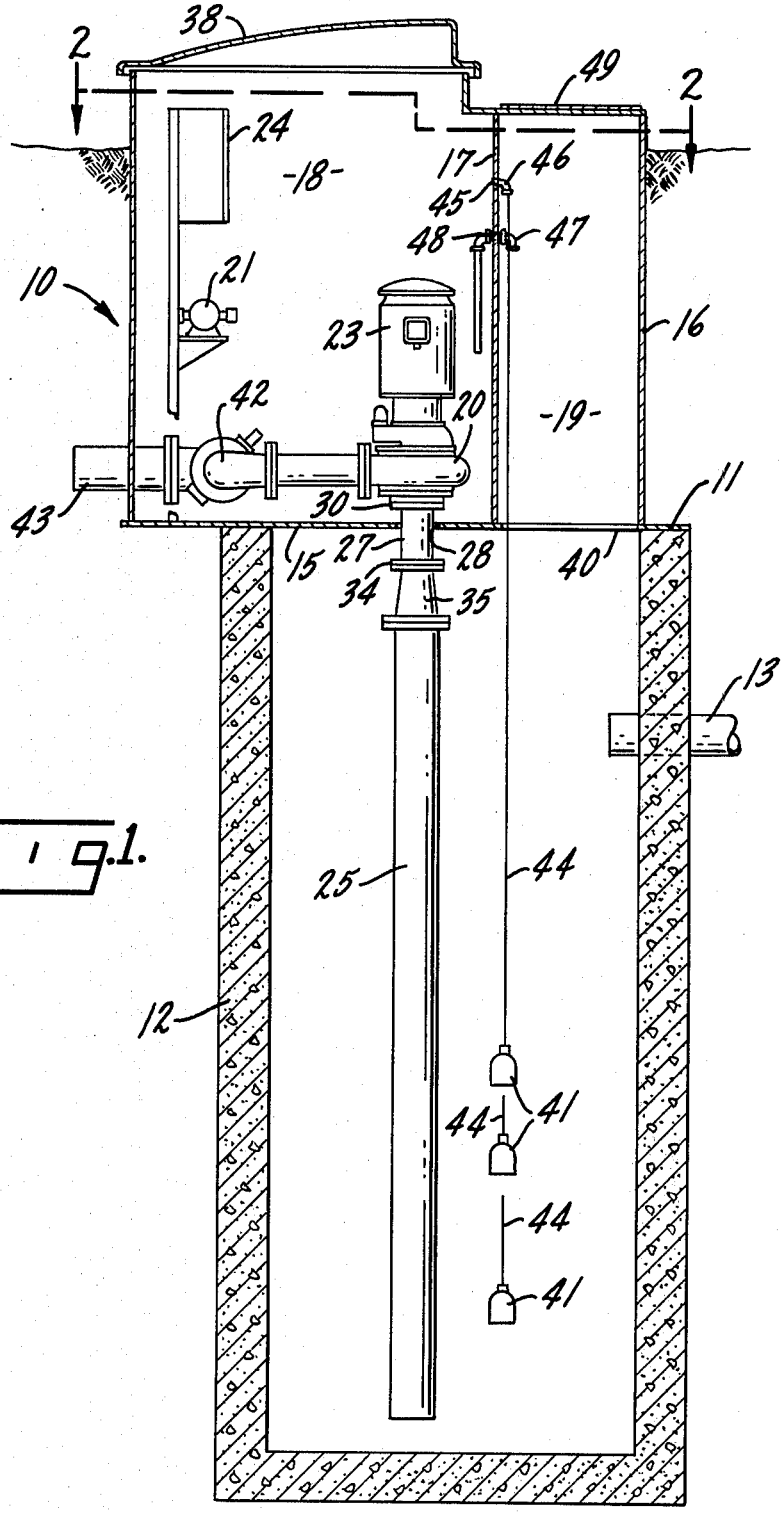
FIG. 1 is a cross-sectional view of a sewage pumping station in accord with this invention.

The drawing shows a sewage pumping station 10 mounted on the top edge 11 of a standard cylindrical concrete wet well 12. Sewage enters wet well 12 through an inlet pipe 13.

Station 10 has a generally horizontal, flat, metal floor 15 that overlies and is fitted on to the upper edge 11 of wet well 12. A generally right circular cylindrical, metal peripheral wall 16 extends vertically upwardly from floor 15 and defines the interior of station 10. Wall 16 is welded to the upper surface of floor 15 around its entire lower edge so as to provide a hermetic seal therebetween. A generally vertical flat metal partition 17 extends upwardly from floor 15 within the confines of wall 16. The bottom and side edges of partition 17 are welded to floor 15 and to wall 16 so as to divide the interior of station 10 into a machinery chamber 18 and an access chamber 19 which are hermetically isolated from each other. At least a portion of each of chambers 18 and 19 is directly vertically above the open interior of wet well 12.

Machinery chamber 18 contains the conventional operating components of a sewage pumping station, such as one or more sewage pumps 20 and electrically operated vacuum pumps 21 for priming pumps 20. Electric motors 23 power pumps 20, and conventional electric circuitry in a control panel 24 regulates the operation of the motors. Pumps 20 are located directly above wet well 12, and sewage inlet conduit means 25 extends vertically downwardly from each pump and terminates adjacent the bottom of the wet well. Each conduit means 25 includes a unitary cylindrical metal pipe 27 that extends downwardly from its associated pump 20 into the top of wet well 12 thru a hole 28 in floor 15. Holes 28 are hermetically sealed because pipes 27 are welded at 29 to the entire edge of floor 15 that defines these holes. An annular flange 30 at the upper end of each pipe 27 is connected to a pump 20 by bolts 32 threaded into a flange 33 on pump 20, and an annular flange 34 at the lower end of each pipe 27 is connected to another component 35 of a conduit means 25 by bolts 36 threaded into nuts 37. Thus floor 15 is imperforate except for holes 28 and chamber 18 is hermetically isolated from the inside of wet well 12. The top of machinery chamber 18 is closed by removable means such as a pivotable cover 38. Chamber 18 may also include conventional components such as a ladder, sump and sump pump, ventilators, check valves, and fit-up plates around conduit means 25, but such components have been omitted from the drawing because their details are not a part of this invention.

In access chamber 19 a manway opening 40 in floor 15 provides continous access to the inside of wet well 12 beneath station 10. The circuitry for controlling the operation of pump station 10 will usually include conventional electrical components, such as displacement switches 41, for sensing the level of the sewage in wet well 12. As sewage rises and falls in wet well 12 one or more of the switches 41 are activated of deactivated, and this turns one or both pumps 20 on or off in known manner. When either pump 20 is in operation, sewage is drawn upwardly through inlet conduit means 25 and is pumped through outlet conduit means 42 into a discharge pipe 43. Switches 41 are suspended in wet well 12 on electrical conductor wires 44 that pass horizontally through a hole 45 near the top of partition 17 that is hermetically sealed by gasket means 46. The discharge pipe 47 of a sump pump (not shown) also passes through an elevated hole 48 in partition 17 that is hermetically sealed by suitable gasket means. This permits such a sump pump to discharge into wet well 12 without the need for holes through floor 15. A separate removable cover 49 closes the top of access chamber 19.

Cover 49 should not be sealed shut to permit escape of gasses from chamber 19.

It has thus been shown that by the practice of this invention the machinery chamber 18 of a sewage pumping station 10 can be hermetically isolated from the inside of the wet well 12 upon which station 10 is mounted. This is accomplished by keeping the floor 15 of chamber 18 imperforate except for inlet conduit holes 28 which are sealed by welding, and by eliminating the need for seals, fasteners, and bushings that pass through the floor. Continuous access to the underside of station 10 and to the inside of wet well 12 for repair or maintenance is provided through manway opening 40 in floor 15 within the confines of access chamber 19. Any components of station 10 other than conduit means 25 that must be in communication with the inside of wet well 12 are passed through sealed holes in partition 17. Thus, control wires 44 pass through a sealed hole 45 and sump pump discharge pipe 47 passes through sealed hole 48. The seals for the elevated holes 45 and 48 in partition 17 are subject to much less wear, damage, and corrosion than the same seals would be in floor 15, and therefore will keep chamber 18 hermetically isolated from chamber 19 for longer periods without needing replacement. Also, since the sewer gases in chamber 19 can easily escape to the atmosphere through unsealed cover 49, they are not likely to pass through any faulty seal in partition 17 into the closed machinery chamber 18.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A sewage pumping station mounted on a sewage wet well, said pumping station comprising:

A. a floor overlying and fitted on said wet well;

B. a peripheral wall around said floor defining the interior of said pumping station;

C. a generally vertical partition extending upwardly from said floor within said peripheral wall, said partition dividing the interior of said pumping station into a machinery chamber and an access chamber, at least a portion of each of said chambers being above said wet well, and said partition hermetically isolating said chambers from each other;

D. said machinery chamber containing sewage pumping means above said wet well and sewage conduit means extending from said sewage pumping means through a hole in said floor into said wet well, means sealing said hole around said conduit means such that said machinery chamber is hermetically isolated from said wet well, and removable cover means for closing the top of said machinery chamber; and E. a manway opening in said floor within said access chamber that provides access to the inside of said wet well beneath said pumping station.

2. The invention defined in claim 1, further comprising means for controlling the operation of said sewage pumping means passing through said partition and extending through said manway opening into wet well.

3. The invention defined in claim 2, wherein said means for controlling the operation of said sewage pumping means comprises displacement switches suspended by wires extending through said manway opening.

4. The invention defined in claim 1, wherein said sewage conduit means comprises unitary pipe means passing through said hole in said floor of said machinery chamber, said pipe means having flange means at its upper end within said machinery chamber connected to said sewage pumping means and having flange means at its bottom end within said wet well connected to other pipe means that terminates adjacent the bottom of said wet well.

5. The invention defined in claim 4, wherein said hole in said floor of said machinery chamber is hermetically sealed by welding said unitary pipe means to the edge of said floor that defines said hole.

6. The invention defined in claim 1, wherein said peripheral wall is a right circular cylinder.

7. The invention defined in claim 1, further comprising separate removable cover means for closing the top of said access chamber.

8. A sewage pumping station mounted on the top peripheral edge of an open ended sewage wet well, comprising:

A. a generally horizontal floor overlying and fitted on said wet well;

B. a peripheral wall extending upwardly from said floor and defining the interior of said pumping station;

C. a generally vertical partition extending upwardly from said floor within said peripheral wall, said partition dividing the interior of said pumping station into a machinery chamber and an access chamber, at least a portion of each of said chambers being directly vertically above said wet well, and said partition hermetically isolating said chambers from each other;

D. said machinery chamber containing electrically operated sewage pumping means directly above said wet well and sewage conduit means comprising unitary pipe means extending downwardly from said sewage pumping means through a hole in said floor into said wet well, said pipe means having flange means at its upper end within said machinery chamber connected to said sewage pumping means and having flange means at its bottom end within said wet well connected to other pipe means that terminates adjacent the bottom of said wet well, said hole being sealed by welding said unitary pipe means to the edge of said floor that defines said hole in said pumping station such that said machinery chamber is hermetically isolated from said wet well, and removable cover means for closing the top of said machinery chamber; and E. a manway opening in said floor within said access chamber that provides continuous access to the inside of said wet well beneath said pumping station, said means for controlling the operation of said pumping station comprising displacement switches suspended in said wet well by wires that pass horizontally through an elevated hole in said partition and extend downwardly through said manway opening, and a separate removable cover closing the top of said access chamber.

9. The invention defined in claim 8, wherein said floor beneath said machinery chamber is imperforate except for said hole in which said unitary pipe means is welded.

* * * * *